US009587826B2

(12) United States Patent
Szadurski et al.

(10) Patent No.: US 9,587,826 B2
(45) Date of Patent: Mar. 7, 2017

(54) GAS BURNER

(71) Applicant: Worgas Burners Limited, a British company, Middlesex (GB)

(72) Inventors: Marek Leopold Szadurski, Middlesex (GB); Anthony Bailey, Middlesex (GB); Craig Stuart Orson, Middlesex (GB)

(73) Assignee: Worgas Burners, Limited, A British Company, Middlesex (GB)

( * ) Notice: Subject to any disclaimer, the term of this patent is extended or adjusted under 35 U.S.C. 154(b) by 541 days.

(21) Appl. No.: 13/761,666

(22) Filed: Feb. 7, 2013

(65) Prior Publication Data

US 2014/0170580 A1 Jun. 19, 2014

(30) Foreign Application Priority Data

Dec. 19, 2012 (GB) ..... 1222929.0

(51) Int. Cl.
*F23D 14/14* (2006.01)
*F23D 14/30* (2006.01)
*F23D 14/46* (2006.01)

(52) U.S. Cl.
CPC ..... *F23D 14/14* (2013.01); *F23D 14/30* (2013.01); *F23D 14/46* (2013.01); *F23D 2203/101* (2013.01); *F23D 2203/102* (2013.01)

(58) Field of Classification Search
CPC ... F23D 14/14; F23D 14/145; F23D 2203/102
USPC ..... 126/41 R, 92 R, 343.5 A; 431/326–329
See application file for complete search history.

(56) References Cited

U.S. PATENT DOCUMENTS 1,397,662 A * 11/1921 Shand et al. ..... 431/346
3,202,204 A * 8/1965 Jouard ..... 431/329
3,219,097 A * 11/1965 Prince et al. ..... 431/328
3,298,419 A 1/1967 Arthur
(Continued)

FOREIGN PATENT DOCUMENTS

EP 2713105 4/2014
GB 191419073 A * 0/1915 ..... F23D 14/58
(Continued)

OTHER PUBLICATIONS

UK Search Report from Application No. GB1222929.0, mailed May 1, 2014, pp. 1-3.
(Continued)

*Primary Examiner* — Jorge Pereiro
(74) *Attorney, Agent, or Firm* — Meyertons, Hood, Kivlin, Kowert & Goetzel, P.C.; Eric B. Meyertons

(57) ABSTRACT

A gas burner 10 intended to point downwardly in use. The gas burner comprises a flame strip 24 in the form of a sheet material with a plurality of openings 38 therein to define ports for combustion gas. The outer side of the flame strip 24 provides a combustion surface in use. The gas burner also comprises a body member 22 with an inlet 18 thereinto for combustion gas. The body member 22 and flame strip 24 together define a combustion chamber 50, with a space between the flame strip 24 and an outer wall 32 of the body member. The body member 22 and/or flame strip 24 are profiled such that said space varies across the chamber 50 to provide a required flow of combustion gas across the chamber 50.

10 Claims, 3 Drawing Sheets

(56) References Cited

U.S. PATENT DOCUMENTS

| | | | | | |
|---|---|---|---|---|---|
| 3,311,156 | A | * | 3/1967 | Fannon, Jr. | 431/72 |
| 3,437,415 | A | | 4/1969 | Davis | |
| 3,494,350 | A | * | 2/1970 | Perl | 126/39 J |
| 3,510,239 | A | * | 5/1970 | Partiot | 431/328 |
| 3,593,647 | A | * | 7/1971 | Copeland, Jr. | 99/339 |
| 4,063,873 | A | * | 12/1977 | Naito | 431/328 |
| 4,170,981 | A | * | 10/1979 | Hakata et al. | 126/43 |
| 5,427,525 | A | * | 6/1995 | Shukla et al. | 431/350 |
| 5,458,484 | A | * | 10/1995 | Ripka | 431/353 |
| 5,601,073 | A | * | 2/1997 | Shimek | 126/512 |
| 5,718,573 | A | * | 2/1998 | Knight et al. | 431/354 |
| 5,722,824 | A | * | 3/1998 | Beck | 431/125 |
| 5,829,693 | A | * | 11/1998 | Schenk et al. | 241/72 |
| 5,964,213 | A | * | 10/1999 | Tran | 126/39 R |
| RE36,743 | E | * | 6/2000 | Ripka | 431/353 |
| 6,461,149 | B1 | | 10/2002 | Ahmady | |
| 6,461,150 | B1 | * | 10/2002 | Sirand | 431/329 |
| 6,612,834 | B2 | * | 9/2003 | Sirand | 431/329 |
| 7,926,479 | B2 | * | 4/2011 | Johnson et al. | 126/92 AC |
| 8,951,040 | B2 | * | 2/2015 | Rasi | 431/355 |
| 2001/0036610 | A1 | * | 11/2001 | Wood | 431/328 |
| 2009/0263757 | A1 | | 10/2009 | Kaupert | |

FOREIGN PATENT DOCUMENTS

| | | | | |
|---|---|---|---|---|
| JP | 58127009 | A | * | 7/1983 |
| JP | 62196517 | | | 8/1987 |

OTHER PUBLICATIONS

European Search Report for EP Application No. EP 13164095, issued Apr. 26, 2016.

* cited by examiner

GAS BURNER

This invention concerns a gas burner, particularly a gas burner intended to face downwardly in use, and especially a gas burner for use as a grill or a radiant heater.

A number of gas burners have previously been proposed for use as a grill. Conventionally these include a structure defining a combustion surface, and a further structure behind the combustion surface which defines a chamber into which combustion gases flow prior to passing out through ports (openings) in the combustion surface structure, to combust.

It is generally required to provide a substantially equal flow of combustion gas throughout the chamber and through a pattern of ports, to provide consistent combustion across the combustion surface. This is usually achieved by providing a baffle arrangement within the combustion chamber.

According to the present invention there is provided a gas burner intended to point downwardly in use, the gas burner comprising a flame strip in the form of a sheet material with a plurality of openings therein to define ports, with the outer side of the flame strip providing a combustion surface in use, the gas burner also comprising a body member with an inlet thereinto for combustion gas, the body member and flame strip together defining a combustion chamber, with a space between the flame strip and an outer wall of the body member, the body member and/or flame strip being profiled such that said space varies across the chamber to provide a required flow of combustion gas across the chamber.

The flame strip may be formed of a single profiled sheet of material.

The flame strip may be profiled such that a generally mid part thereof defines a minimum space from the chamber outer wall, with the space increasing outwardly from said mid part.

The body member may be at least generally rectangular in plan view. The body member may comprise end and side walls at the perimeter of the body member outer wall.

The inlet in the body member may be provided in one end wall of the body member and may be provided substantially centrally in said one end wall. The mid part of the flame strip may be spaced further from said one end wall of the body member than from the opposite end wall of the body member.

The mid part of the flame strip may be spaced substantially equally between opposite side walls of the body member.

The flame strip may extend in four central planar sections away from the mid part towards respectively the end and side walls of the body member, with the central planar sections diverging relative to the body member outer wall away from the mid part.

Outer planar sections may be provided at outer ends of some or all of the central planar sections, which outer planar sections extend to the respective end or side walls of the body member, with the outer planar sections converging relative to the body member outer wall towards the respective end or side walls of the body member.

The central planar sections may extend for a greater extent than the outer planar sections.

The outer wall of the body member from adjacent the inlet may taper towards the flame strip, and the tapering may end substantially adjacent to the flame strip mid part.

The gas burner preferably does not include any baffle, and the combustion chamber may be formed by just the flame strip and body member.

The flame strip and body member may be joined together around respective perimeters. The flame strip and body member may be joined together by a flange of the flame strip being folded around an edge of the body member.

An embodiment of the present invention will now be described by way of example only and with reference to the accompanying drawings, in which.

Figure 1:
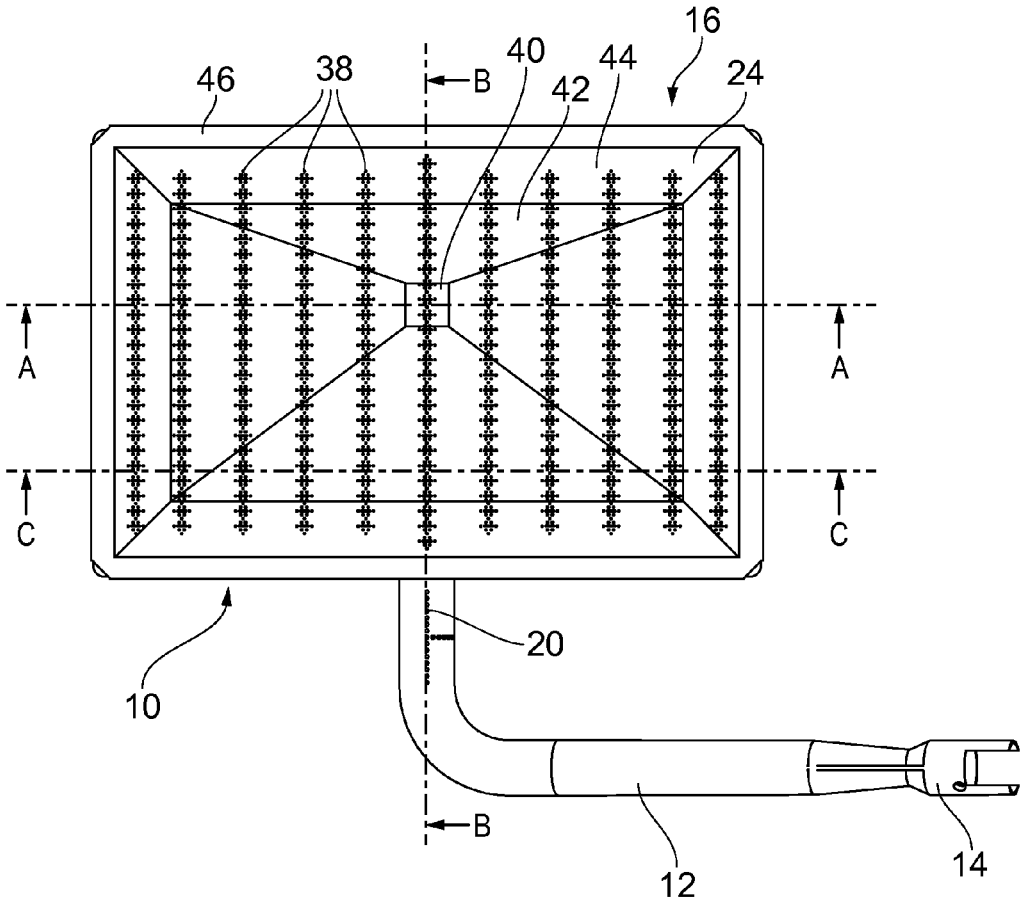
FIG. 1 is a diagrammatic view from beneath of a gas burner according to the invention.
Figure 2:
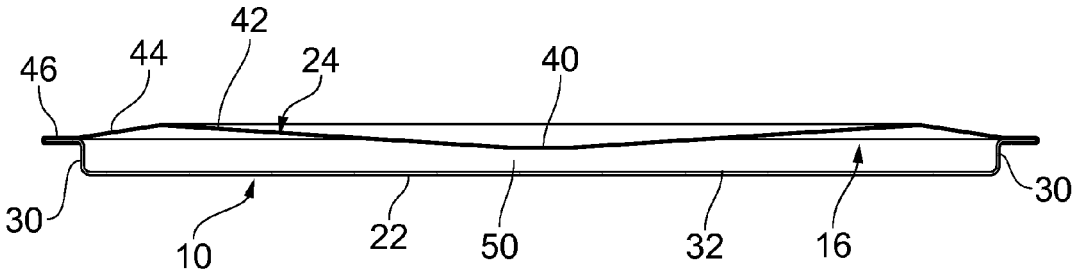
FIG. 2 is a sectional view along the line A-A of FIG. 1.
Figure 3:
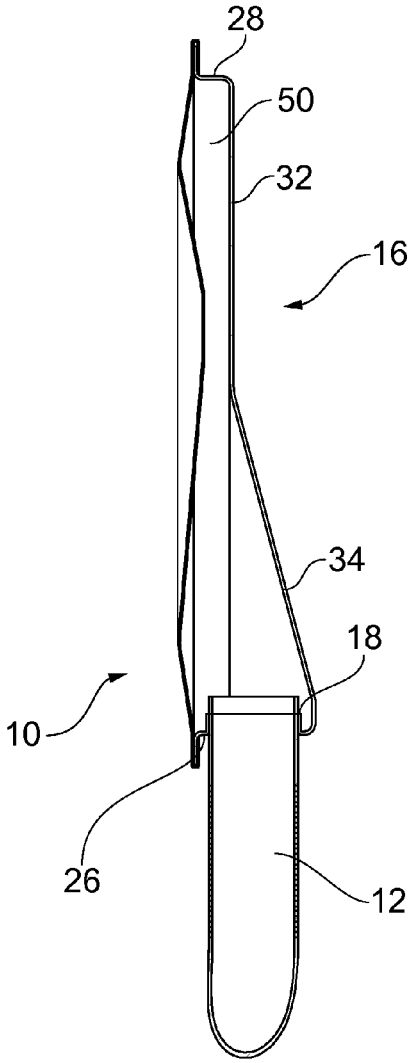
FIG. 3 is a sectional view along the line B-B of FIG. 1.
Figure 4:
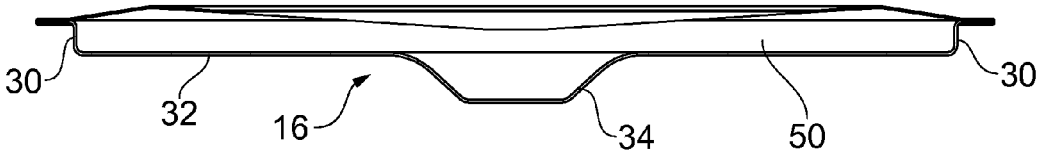
FIG. 4 is a sectional view along the line C-C of FIG. 1.
Figure 5:
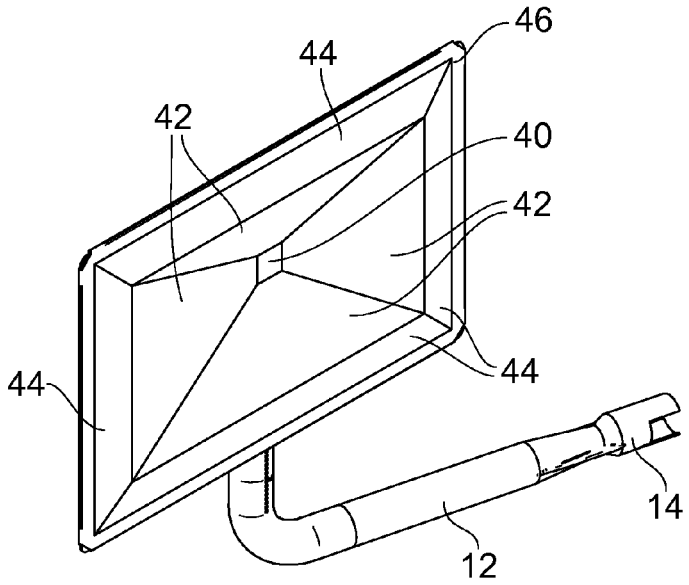
FIG. 5 is a diagrammatic perspective view from beneath of the burner of FIG. 1.

The drawings show a gas burner 10 suitable for use as a downwardly facing grill. The burner 10 includes an inlet pipe 12 for combustion gas, with a venturi connection 14 for connection to a gas source. The pipe 12 connects to a burner head 16 which has an inlet 18. A plurality of small openings 20 are provided on the underside of the pipe 12 adjacent the inlet 18 to permit ignition of the burner 10 by any appropriate device.

The burner head 16 is formed by a body member 22 and a flame strip 24. The body member 22 is essentially a relatively shallow rectangular tray with an end wall 26 in which the inlet 18 is provided, an opposite end wall 28, and two side walls 30. The end and side walls 26, 28, 30 are upstanding from an outer wall 32. The outerwall 32 is substantially planar except for a tapering extension 34 from the inlet 18 to a generally mid point of the outer wall 32.

The flame strip 24 is formed of a profiled sheet of metal, with a pattern of openings 38 therein defining ports for combustion gas. The profiled sheet comprises a mid part 40 which is generally square and is equidistanced between sides of the flame strip 24, but is a little towards one end of the flame strip 24, which end is opposite the inlet 18.

Four central planar sections 42 extend outwardly from the mid part 40, and the planar sections 42 diverge from the body member outer wall 32. Each of the central planar sections 42 extends to a respective outer smaller planar section 44 which converges towards the body member outer wall 32, and the outer planar sections 44 extend to a mounting flange 46 extending around the perimeter of the flame strip 24.

Figure 6:
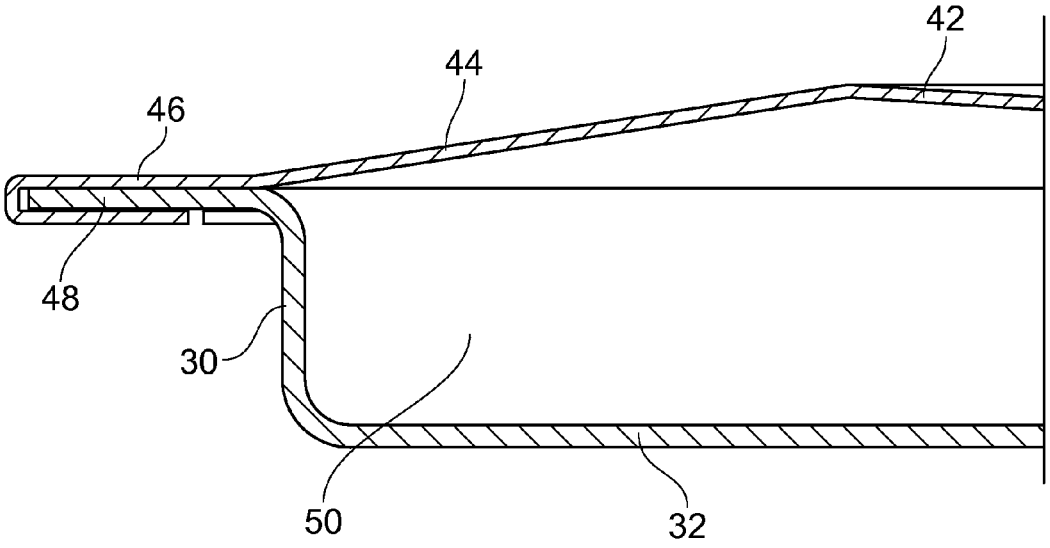
FIG. 6 is a diagrammatic enlarged sectional view through an edge part of the apparatus of FIG. 1.

The flame strip 24 and body member 22 are mounted together by the mounting flange 46 being folded over a flange 48 provided around the body member 22, as can be best seen from FIG. 6. The flame strip 24 and body member 22 together define a combustion chamber 50.

In use, gas will enter the burner head 16 through the pipe 12 and hence inlet 18. The burner head 16 can be lit by the openings 20. Gas entering the combustion chamber 50 will tend to accelerate towards the mid part 40 by virtue of the narrowing of the space at this point between the flame strip 24 and body member 22. Gas will then move outwardly in all directions from the mid part 40, and will tend to decelerate and spread out by virtue of the diverging central planar sections 42. The outer planar sections 44 will cause a little acceleration of gas at the perimeter of the burner head 16, and will help to ensure that gas reaches right out to this perimeter.

During burning the flame strip 24 in particular will become hot and tend to expand. The arrangement of the flanges 46, 48, enables the flame strip 24 to expand and the mounting flange 46 to slide outwardly relative to the flange 48 on the body member 22. This helps to alleviate buckling of the flame strip 24 and helps to avoid contraction and other noises during burning.

There is thus described a gas burner with a burner head made of only two components, but which provides for a good distribution of gas thereacross. The mounting together of the body member and flame strip does not require welding, and provides advantages in avoiding noise during burning as outlined above.

Therefore a gas burner is provided with enhanced performance but made of a small number of components with inexpensive fabrication techniques. Accordingly the burner can be made relatively inexpensively but to provide long term efficient performance.

Various modifications may be made without departing from the scope of the invention. For instance the body member and/or flame strip may take a different form. A different arrangement of ports could be provided. A different ignition system could be used. The burner could be a different shape.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

The invention claimed is:

1. A gas burner intended to point downwardly in use, the gas burner comprising a flame strip in the form of a sheet material with a plurality of openings therein to define ports, with the outer side of the flame strip providing a combustion surface in use, the gas burner also comprising a body member with an inlet thereinto for combustion gas, the body member and flame strip together defining a plenum chamber, said body member comprising an outer wall opposite said flame strip, with a space between the flame strip and said outer wall of the body member, the body member and/or flame strip being profiled such that said space varies across the chamber to provide a required flow of combustion gas across the chamber; wherein the body member comprises end and side walls at the perimeter of the body member outer wall, said end and side walls defining respective intersecting planes which also further intersect a plane defined by said outer wall; and wherein the flame strip is profiled such that a generally mid part thereof defines a minimum space from the chamber outer wall, said mid part offset from the periphery of said flame strip, with the space increasing outwardly from said mid part, the mid part of the flame strip being spaced further from said one end wall of the body member than from the opposite end wall of the body member.

2. A gas burner according to claim 1, in which the flame strip is formed of a single profiled sheet of material.

3. A gas burner according to claim 1, in which the body member is at least generally rectangular in plan view.

4. A gas burner according to claim 1, in which the inlet in the body member is provided in one end wall of the body member.

5. A gas burner according to claim 4, in which the inlet in the body member is provided substantially centrally in said one end wall.

6. A gas burner according to claim 1, in which the flame strip is profiled such that a generally mid part thereof defines a minimum space from the chamber outer wall, with the space increasing outwardly from said mid part, the mid part of the flame strip being spaced substantially equally between opposite side walls of the body member.

7. A gas burner according to claim 1, in which the outer wall of the body member from the inlet tapers towards the flame strip, and the tapering ends coincident with the minimum space.

8. A gas burner according to claim 1, in which the gas burner does not include any baffle.

9. A gas burner according to claim 1, in which the combustion chamber is formed by just the flame strip and body member.

10. A gas burner according to claim 1, in which the flame strip and body member are joined together around respective perimeters.

* * * * *